United States Patent [19]

Steinmetz

[11] 4,354,679

[45] Oct. 19, 1982

[54] GAME BAG

[76] Inventor: Richard D. Steinmetz, 91448 Steinmetz Rd., Junction City, Oreg. 97448

[21] Appl. No.: 252,333

[22] Filed: Apr. 9, 1981

[51] Int. Cl.[3] ..... A63B 37/02

[52] U.S. Cl. ..... 273/58 A; 273/415

[58] Field of Search ..... 273/58 A, 58 F, 415, 273/65 ED, 65 EC

[56] References Cited

U.S. PATENT DOCUMENTS

| | | | |
|---|---|---|---|
| 1,140,845 | 5/1915 | Oliver | 273/58 A |
| 1,960,803 | 5/1934 | Baumer | 273/65 ED |
| 3,937,470 | 2/1976 | Stalberger et al. | 273/415 |
| 4,151,994 | 5/1979 | Stalberger | 273/58 A |

*Primary Examiner*—George J. Marlo

*Attorney, Agent, or Firm*—James D. Givnan, Jr.

[57] ABSTRACT

A bag of spherical construction having a pliable cover formed from pentagonal shaped cover members stitched to one another along their common sides to form a dodecahedron. Filler for the present game bag is of a discrete nature. Stitching along adjacent sides of the cover members provides elongate zones of greater ridigity than the center area of each cover member and contributes to the retention of a faceted spherical shape even after long use. The cover members are approximately one inch in their greatest transverse dimension.

4 Claims, 4 Drawing Figures

GAME BAG

BACKGROUND OF THE INVENTION

The present invention relates generally to construction of a generally spherical article used in athletic contests as well as for general recreational purposes.

The present article is used primarily by individuals or groups participating in the sport of foot bag which essentially entails the keeping of an article or ball in motion by repetitive contact with a part of the player's torso or legs. U.S. Pat. No. 3,937,470 discloses a game bag with both flat and curved exterior surfaces.

Information regarding the game is included in U.S. Pat. No. 4,151,994 which patent discloses ball construction utilizing a ball of figure eight shaped cover members. The ball construction disclosed therein includes stitched marginal portions of the figure eight shaped members which stitching follows a figure eight pattern analogous to baseball cover construction. A shortcoming of known game bag construction is that the bag is out-of-round or of ovoidal shape with "flattened" areas rendering its rebound characteristics unpredictable.

SUMMARY OF THE PRESENT INVENTION

The present invention is embodied within ball construction using small polygonal shaped members stitched together along their common edges to provide a ball shaped article with an exterior of symmetrical configuration.

The present article is of ball shape and is particularly suited for use by those participating in the game of foot bag, which entails keeping the ball airborne by successive forceful contact with the torso or leg of a participant or participants. The activity is conducive to the development of the participant's coordination.

A desirable feature of a game bag or ball is that it is characterized by low rebound propensity. As same may be impacted by curved or irregular surfaces of the anatomy, the low rebound characteristic renders its trajectory somewhat more predictable. Additionally important to a ball with preferred rebound characteristics is that the cover be of durable, pliant construction which is accomplished by the use of thin tanned hide, preferably pigskin. Closely spaced seams joining the straight marginal edges of the relatively small cover members contribute to providing a ball shaped article of symmetrical configuration and one which resists losing its shape after extended use.

Important objects of the present invention include the provision of a ball shaped article for recreational use having a multitude of relatively small cover members of polygonal shape having multiple lines of stitching joining the common marginal edges of adjacent members to provide a game bag of desired generally spherical shape not susceptible to re-shaping by use; the provision of a recreational ball having a multitude of pentagonal cover members each characterized by inwardly turned marginal areas each being of substantial magnitude which confine ball filling pellets for the purpose of retaining a generally round configuration of the ball.

DETAILED DESCRIPTION OF THE PREFERRED EMBODIMENT

Figure 1:
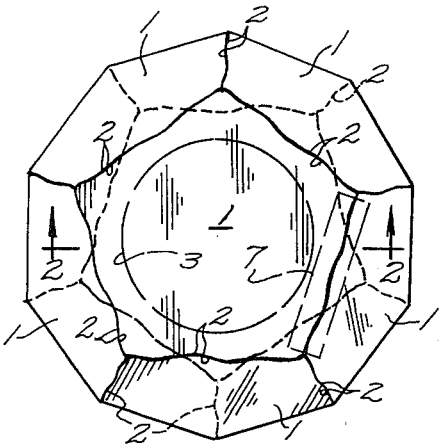
FIG. 1 is a plan view of the present ball with uniform cover members and with unseen cover members shown in dashed lines.

With continued attention to the drawing the reference numeral 1 indicates cover members of the present ball, said cover members as viewed are of substantially polygonal shape having juxtaposed exposed edges at 2.

A central area of each cover member is indicated by phantom lines at 3.

Figure 2:
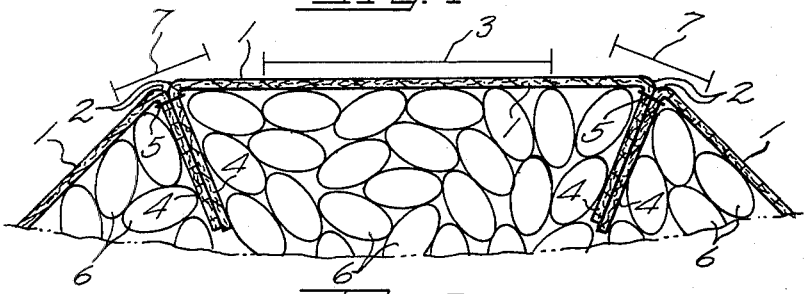
FIG. 2 is a vertical sectional view taken along line 2—2 of FIG. 1 on a greatly enlarged scale.

With attention to FIG. 2 wherein a typical cross section of a cover member is shown, the edges 2 of each cover member define the outer limits of inwardly directed marginal areas at 4 which are of a greater width, approximately one-quarter inch, when compared with conventional ball construction.

Indicated at 5 are lines of stitching which extend through contiguous or abutting marginal areas 4 of adjacent cover members. Lines of stitching 5 provide a desired degree of rigidity along the stitched edges of abutting cover members to enhance retention of the spherical shape even after long use. Stitching is accomplished in a manner wherein the game bag is formed inside out, reversed and filled prior to bag closing by stitching of two pairs of juxtaposed marginal areas 4.

Figure 3:
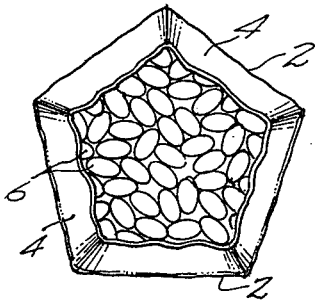
FIG. 3 is a plan view on an enlarged scale of the inner side of a typical cover member separated from adjacent cover members.

Occupying the ball interior is a quantity of discrete material in the form of oval polypropylene casting pellets 6 elliptical in lengthwise section which are approximately one-eight inch in their longest dimension when the ball is of a diameter of approximately two inches. With attention to FIG. 2, it will be seen that the marginal areas 4 cooperate to define laterally closed areas located immediately inward of the cover member exterior. Marginal areas 4 define, with the cover member exterior, an acute angle which serves to restrict pellet migration during impact of a force on the ball exterior. FIG. 3 is believed illustrative of the arrangement described and shows a quantity of pellets confined within a marginal area defined enclosure.

Figure 4:
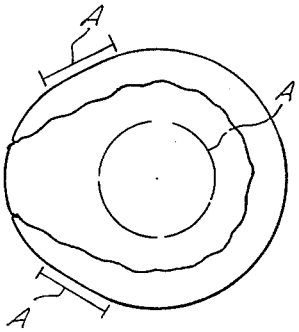
FIG. 4 (PRIOR ART)
FIG. 4 is an elevational view of a prior art game bag.

Indicated at 7 are elongate zones including the common edges of adjacent cover members and which zones are of less resiliency by reason of the stitching 5. With the present game bag formed as a dodecahedron with a diameter of about two inches it will be seen that bag contact with the anatomy will involve both resilient zones 3 and somewhat less resilient zones 7 in distinction to earlier game bags having relatively large surface areas and widely spaced lines of stitching permitting impact either entirely on an unstitched area or conversely impact on an area occupied by closely spaced apart distinct rows of stitching having different rebound characteristics than the first mentioned unstitched area. The "flattened" areas are indicated at A in the prior art disclosure of FIG. 4 wherein the article is of ovoidal shape.

The present ball shaped article is preferably constructed from leather cover members of tanned pig hide notable for its pliability as well as durability with the cover members being of pentagonal shape having an exposed widest surface area of about one inch when the article is of a diameter of approximately two inches.

Each cover member contributes toward a ball-like article having a faceted appearance wherein the cover members are substantially planer.

The polygonal cover members are punched for purposes of hand stitching which is an alternative to machine sewing of the seams. When hand sewn adjacent edges of the cover members will abut one another in a slightly irregular manner caused by tensioning of the stitching imparting a slight gathering of the material used for the cover members. When machine stitched, the edges of the cover members are straight.

While I have shown but one embodiment of the invention it will be apparent to those skilled in the art that the invention may be embodied still otherwise without departing from the spirit and scope of the invention.

Having thus described the invention, what is claimed and desired to be secured under a Letters Patent is:

1. Bag construction for a ball-like article used for recreational purposes, said article construction comprising:

a plurality of pliable cover members each being of polygonal shape and having its perimetrical edges in juxtaposition with a like edge of an adjacent member, each of said members having inwardly extending marginal areas, intersecting lines of stitching joining adjacent cover members along their juxtaposed edges, filler material of a discrete nature fully occupying the ball interior, and said intersecting lines of stitching serving to reinforce the cover members against deformation along said abutting marginal areas.

2. The ball-like article claimed in claim 1 wherein said ball-like article is a dodecahedron with said cover members being of pentagonal shape and having their greatest transverse dimension approximately one inch in length.

3. The ball-like article of claim 2 wherein said marginal areas of each cover member are approximately one quarter of an inch wide and define a pentagonal shaped area of confinement for the filler material.

4. The ball-like article claimed in claim 3 wherein each of said cover members is substantially planer.

* * * * *